United States Patent [19]

Cotton

[11] 3,989,561

[45] Nov. 2, 1976

[54] METHOD OF APPLYING A LAMINATED INSULATING FILM TO COPPER WIRE

[75] Inventor: Dale L. Cotton, La Grange, Ill.

[73] Assignee: General Motors Corporation, Detroit, Mich.

[22] Filed: May 19, 1975

[21] Appl. No.: 578,610

Related U.S. Application Data

[63] Continuation-in-part of Ser. No. 418,673, Nov. 23, 1973.

[52] U.S. Cl. ..... 156/54; 174/117 FF

[51] Int. Cl.[2] ..... H01B 13/26

[58] Field of Search ..... 156/54, 48, 56, 55, 156/47, 50, 185; 427/377; 267/25, 85; 174/117 F, 117 FF; 428/421, 463

[56] References Cited

UNITED STATES PATENTS

| | | | |
|---|---|---|---|
| 3,359,096 | 12/1967 | Jost | 427/377 X |
| 3,408,453 | 10/1968 | Shelton | 174/117 FF X |
| 3,777,198 | 12/1973 | Anderson et al. | 310/43 X |

FOREIGN PATENTS OR APPLICATIONS

| | | | |
|---|---|---|---|
| 221,378 | 4/1958 | Australia | 156/54 |

*Primary Examiner*—David A. Simmons
*Attorney, Agent, or Firm*—Jack I. Pulley

[57] ABSTRACT

In a preferred form, this disclosure relates to a method for continuously applying a polyimide electrically insulating film laminated on one side with a fluorinated resin such as that marketed by DuPont under the trade designation Teflon FEP-fluorocarbon resin onto a metal conductor. The method includes the steps of (a) simultaneously longitudinally feeding the conductor and the laminated film with the fluorinated resin side adjacent the conductor into a guide means, (b) partially wrapping the film around the metal conductor into a guide means, (c) passing the partially wrapped conductor and the film through a first heater means, in an inert atmosphere to preheat the copper conductor to a temperature of from about 500° F. to about 600° F., (d) completely wrapping the laminated film, in an inert atmosphere, around the conductor by sequentially folding the ends over the conductor in an overlapping relationship to define a longitudinally extending seam, (e) heating the fully wrapped conductor in an inert atmosphere to a temperature of at least 700° F., but below that temperature at which the polyimide will rapidly degrade to soften the fluorinated resin layer and allow it to flow into intimate contact with conductor while maintaining the wrapped film in clamped engagement with the sides of the conductor, and then cooling the wrapped conductor in an inert atmosphere to cause the fluorinated resin to harden and bond the film to the metal conductor.

4 Claims, 6 Drawing Figures

METHOD OF APPLYING A LAMINATED INSULATING FILM TO COPPER WIRE

This is a continuation-in-part of application 418,673, filed Nov. 23, 1973.

The present invention relates to a method for continuously applying a laminated electrically insulating film onto a metal conductor, and in particular to a method of continuously applying such a film to a metal conductor by heating the conductor and film, in an inert atmosphere, to allow the inner layer of the laminate to soften and to flow into intimate contact with the conductor, and then cooling the same while maintaining the film and conductor in clamped engagement and in the inert atmosphere.

Insulated copper wires are commonly made by extruding a plastic sheath, such as polyvinyl chloride, around the copper conductor. It has also been proposed to extrude rubber or other plastic materials which must be heat cured around a copper conductor by passing the same through a heater in an inert atmosphere. For example, see U.S. Pat. No. 3,513,228.

It is also known to insulate varnish coated copper wire with a polyimide film or tape and with the film being applied in a turn to turn fashion to form a spiral wrap.

The present invention is specifically directed to applying and bonding a specific laminated insulating film, namely a fluorinated ethylene-propylene resin-polyimide laminate, onto a metal conductor, preferably copper, in a continuous fashion. Accordingly, an important object of the present invention is to provide a new and improved method for applying and bonding a fluorinated ethylene-propylene resin-polyimide laminated insulating film onto a metal conductor and which method includes the steps of: (a) simultaneously longitudinally feeding the metal conductor and the laminated film, with the fluorinated ethylene-propylene resin (hereinafter FEP) layer adjacent the copper conductor, into a guide and wrapping means; (b) wrapping the film, in an inert atmosphere, around the metal conductor in the guide and wrapping means with the adjacent side ends of the film being in a folded overelapping relationship to define a longitudinally extending seam; (c) heating the fully wrapped conductor in an inert atmosphere to a temperature of about at least 700° F. to cause the FEP layer to soften and flow into intimate contact with the copper while maintaining the wrapped film in clamped engagement with the sides of the conductor, and then cooling the wrapped conductor in an inert atmosphere thereby causing the FEP layer to harden and bond the film to the copper conductor.

Another object of the present invention is to provide a new and improved method of continuously applying and bonding an FEP-polyimide laminated insulating film onto a metal conductor, as defined in the preceding object, and in which the film is partially wrapped in a first guide means, passed through a preheater means in which the copper conductor is heated to a temperature of from about 500° F. to about 600° F. and then the film is fully wrapped about the conductor prior to being passed through a second heater means in which the copper conductor is heated to a temperature of at least 700° F.

The advantages of the present invention are: (1) a good bond can be achieved between the copper wire and the laminated film which bond greatly reduces electrical moisture grounds when the insulated wire is used in an armature coil in an electric motor, (2) the process lends itself to relatively high speed operation, and (3) when used as an armature coil it enables the armature coil to be made of one piece.

The present invention further resides in various novel constructions and arrangements of parts, and further objects, novel characteristics and advantages of the present invention will be apparent to those skilled in the art to which it relates from the following detailed description of the illustrated embodiments thereof made with reference to the accompanying drawings forming a part of this specification and in which similar reference numerals or characters are employed to designate corresponding parts throughout the several views, and in which.

Figure 1:
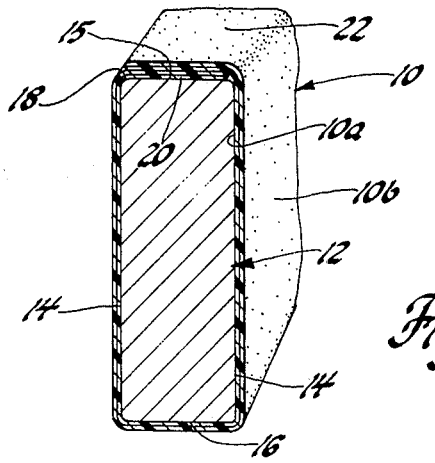
FIG. 1 is a cross sectional and perspective view of an insulated metal conductor.

The present invention relates to a novel method for continuously applying and bonding an FEP-polyimide laminated insulated film 10 onto a metal conductor 12, preferably made from copper. The copper conductor 12 is preferably of a rectangular shape, as viewed in cross section, to define opposed sides 14 and upper and lower sides 15 and 16 as viewed in FIG. 1. The copper conductor 12 at its corners is rounded or radiused, as indicated by reference numeral 18. The lamainated insulating film 10 has its FEP side **10*a* bonded to the copper conductor 12 and with the polyimide side 10*b* being exposed. The laminated film 10 has a side edge portion 20 which is folded across the top side 15 of the metal conductor and a side edge portion 22 which is folded across the side edge portion 20 in an overlapping relationship to define a longitudinally extending seam along the top side 15 of the conductor 12, as viewed in FIG. 1**.

Figure 2:
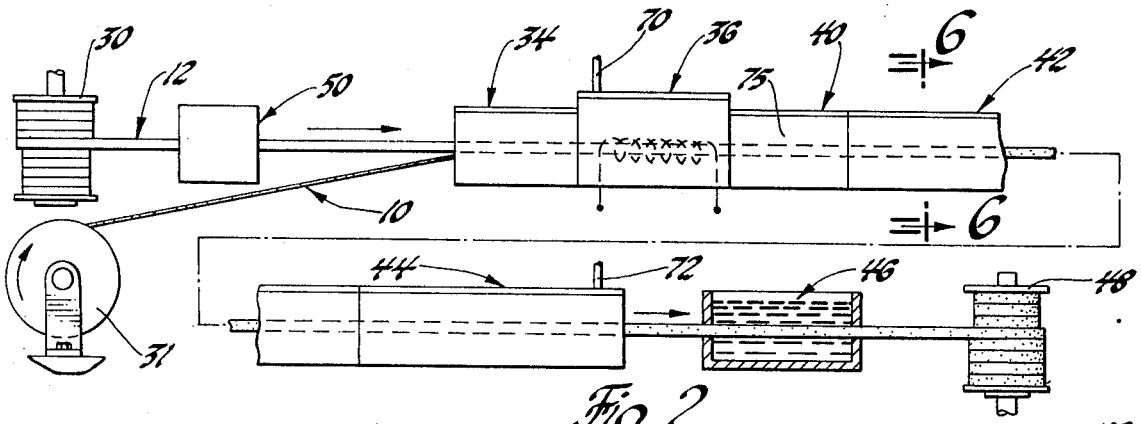
FIG. 2 is a schematic view of the apparatus for carrying out the novel method of the present invention.
Figure 4:
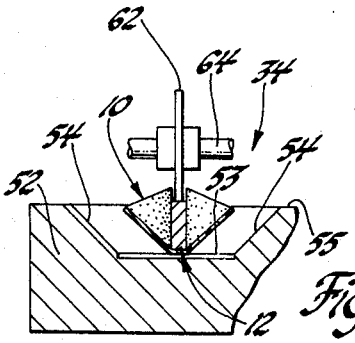
FIG. 4 is a fragmentary view taken approximately along line 4—4 of FIG. 3.
Figure 5:
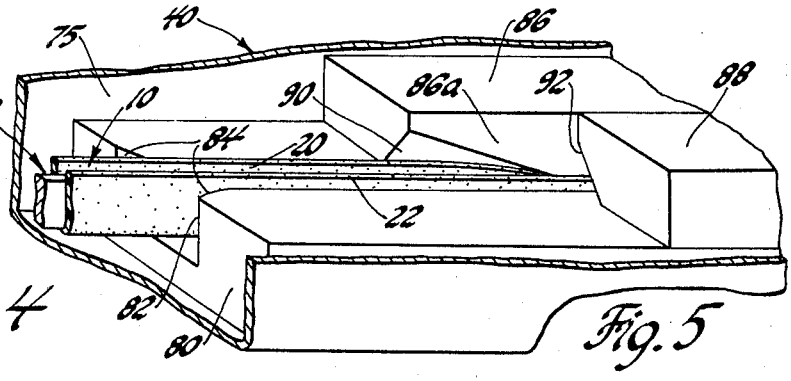
FIG. 5 is a perspective view of part of the apparatus shown in FIG. 2.

FIG. 2 schematically shows an apparatus for carrying out the novel method of the present invention. The apparatus comprises, in general, a feeding means (not shown) for simultaneously longitudinally feeding substantially oxide-free copper wire 12 from a reel 30 and the laminated film 10 from a reel 31 into an inlet side 32 of a tape guide or partial wrapping. means 34 wherein the film 10 is wrapped about the bottom 16 and the sides 14 of the copper conductor 12, as shown in FIG. 4, and with the side edge portions 20 and 22 of the film extending beyond and transversely of the plane of the top side 15 of the metal conductor 12. To ensure that the metal conductor 12 is initially oxide free, a suitable cleaner means or oxide remover means 50 can be provided. The partially wrapped metal conductor 12 is then passed through a preheater 36 in an inert atmosphere to heat the copper conductor 12 to a temperature of from about 500° F. to about 600° F. This preheating step conditions the conductor, which, otherwise would act as a severe heat sink in the second heating step and cause problems therein. Thereafter, the partially wrapped conductor is passed, in an inert atmosphere, through a second guide or final wrapping means 40 wherein the side edge portions 20 and 22 of the film are folded across the top side 15 of the conductor 12 in overlapping relationship to define a longitudinally extending seam. From the final wrapping means 40, the insulated metal conductor is passed in an inert atmosphere through a second heater means 42 which heats the metal conductor 12 and laminated film 10 to a temperature of at least about 700° F. but less than the temperature at which the polyimide layer will begin to thermally degrade at an appreciable rate; typically this upper temperature limit is about 900° F. when the film is in an inert atmosphere. During this second heating step, the film is held in clamped engagement against the conductor for a predetermined length of time to allow the FEP layer to soften and flow into intimate contact with the surfaces of the conductor. After the metal conductor and insulating film have been heated by the heater means 42, they are passed through a first cooling means 44 while being maintained in an inert atmosphere to cool the same to a temperature of preferably from about 300° F. to about 400° F. This first cooling step allows the FEP layer to harden and bond the polyimide film portion to the sides of the metal conductor. Thereafter, the insulated metal conductor passes through a second cooling means 46 and then is rolled up on a take-up reel 48.

Figure 3:
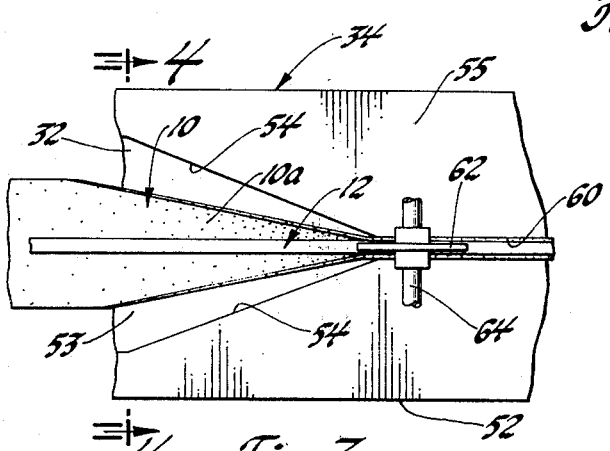
FIG. 3 is a large fragmentary plan view of part of the apparatus shown in FIG. 2.

As best shown in FIGS. 3 and 4, the partial wrapping means or guide means 34 comprises a metal block 52 having its inlet 32 in the form of a V-shaped recess or guide. The V-shaped guide or inlet 32 has a planar bottom wall 53 and linearly tapered or sloping side walls 54 and with the transverse distance of the inlet 32 progressively increasing proceeding from the bottom surface 53 toward the top surface 55 of the block 52. The side walls 54 of the inlet 32 are also linearly tapered in a longitudinal direction so that the width of the inlet 32 progressively decreases, proceeding from left to right as shown in FIG. 3. As the laminated film 10 is fed beneath the bottom side 16 of the metal conductor 12 and with the FEP layer side adjacent the copper conductor 12, the sides of the film engage the sides 54 of the V-shaped inlet 32 to cause the film to be wrapped around the bottom 15 and sides 14 of the metal conductor 12, and with the side edge portions 20 and 22 of the film 10 extending beyond the plane of the top side 15 of the metal conductor 12. As the metal conductor 12 and the film 10 exit from the inlet 32, they pass through an elongated channel or recess 60 having a width just slightly greater than the width of the metal conductor plus about twice the thickness of the laminated film 10. As the partially wrapped metal conductor 12 passes from the inlet 32 through the channel 60, it engages a roller 62 rotatably mounted on a shaft 64 carried by the wrapping means 34. The roller 62 serves to retain the partially wrapped metal conductor 12 in the channel 60.

After the partially wrapped conductor leaves the first guide and wrapping means 34, it passes through the first heater means 36 which can be of any suitable or conventional construction, but is preferably an induction coil heater means which heats the metal conductor to a temperature of preferably between 500° and 600° F. The induction heater means 36 includes a guide means or channel (not shown) for guiding the conductor 12 and partially wrapped film 10 therethrough. Also, the metal conductor 12 as it is being heated by the heater means 36 is in an inert atmosphere, preferably argon gas to prevent the oxidation of the copper and retard the degration of the film. To this end, the induction heater means includes an inlet 70 through which argon gas under pressure is supplied to the interior of the heater means 36 so as to be in intimate contact with the copper conductor 12. As shown in FIG. 2, the heater means 36, the wrapping means 40, the second heater means 42, and the cooler means 44 are abutted or located closely adjacent each other. The argon gas also enters through an inlet 72 in the cooling means 44 and the inert argon gas is circulated from both inlets 70 and 72 through the heater means 36, the wrapping means 40, the second heater means 42 and the cooler means 44. The inert gas exits or leaks out of the entrances and exits of the various apparatus through which the conductor travels. Thus, from the time the partially wrapped conductor 12 enters the heater means 36 until the insulated conductor 12 exits from the cooling means 44, it is in an inert argon gas atmosphere.

After the partially wrapped conductor is preheated, it is fed to the second guide or wrapping means 40 wherein the side edge portions 20 and 22 of the laminated film are folded across the top side 15 of the metal conductor 12. The wrapping means 40 is contained in a housing 75 defining an enclosed chamber through which the inert gas is circulated. The wrapping means 40 comprises a bottom base member 80 made of metal and which has a longitudinally extending rectangularly shaped channel 82 therein for receiving the partially wrapped metal conductor 12. The channel 82 is bevelled at its entrance, as indicated by reference numeral 84, to guide the metal partially wrapped conductor 12 into the channel 82. The wrapping means 40 also includes spaced wrapping blocks 86 and 88 secured to the base 80. The wrapping blocks 86 and 88 have bevelled surfaces 90 and 92, respectively, adjacent their forward ends. Since both bevelled surfaces 90 and 92 are identical, only the bevelled surface 90 will be described in detail. The bevelled surface 90 is flat and it tapers so that its heighth progressively decreases proceeding from its forward end towards its rearward end. Likewise, the width of the bevel surface 90, as measured from a plane containing the side edge **86*a* of the wrapping block 86, progressively decreases from its forward end toward its rearward end. The wrapping blocks 86 and 88 overlie the channel 82 and at their rearward end enclose the channel 82, the height of the channel being just slightly greater than the height of the metal conductor 12 including the thicknesses of the wrapped insulating film 10**.

As the partially wrapped metal conductor 12 enters the wrapping means 40, it will be guided through the channel 82. As it proceeds through the channel 82, the bevelled surface 90 will engage the side edge portion 20 and cause the same to be deflected downwardly and folded across the top surface 15 of the metal conductor 12. As the metal conductor proceeds further into the wrapping means 40, the bevelled surface 92 will engage the side edge portion 22 of the film 10 and cause the same to be deflected and folded across the top of the folded edge portion 20 in overlapping relationship with the side edge portion 20. Thus, the conductor is now fully wrapped and with the side edge portions being in an overlapping relationship to define a longitudinally seam extending along the top side 15 of the metal conductor 12.

After the metal conductor 12 is fully wrapped with the laminated film 10, it passes into the second heater means 42. The second heater means 42 comprises an elongated calrod type heater means comprising a generally U-shaped body portion 100 defining an elongated chamber 102. The calrod heater means includes rod like heating elements 103 which are suitably connected to an electric power source and with the heater means serving to heat the fully wrapped metal conductor 12 via conductive heat. The heater means also includes a suitable cover 104 to enclose the chamber 102 which is supplied with argon gas under pressure to provide an inert atmosphere.

The heater means 42 also includes a guide means 105 for guiding movement of the fully wrapped conductor 12 and for maintaining the sides of the film in clamped engagement with the metal conductor as it is passed through the heater means 42. The guide means 105 comprises a stationary block 110 and a relatively movable block 112 disposed within a channel 114 in the heater body 100. The movable block is spring biased toward the stationary block 110 by compression spring means 115 having one end in abutting engagement with the body portion 100 and their other end in abutting engagement with the movable block 112. Each of the blocks 110 and 112 has a longitudinally extending rectangularly shaped recess adjacent its upper end which provides adjacently facing sides, and which sides together define a channel 116 through which the wrapped conductor 12 can pass. The spring 115 serves to bias the block 112 toward the stationary block 110 so that the film is firmly held against the bottom 16 and sides 14 of conductor 12. The guide means 105 further includes an upper block 117 which overlies the lower blocks 110 and 112 and which is supported on abutment surfaces 118 and 119 on the heater body 100. The upper block has a pair of longitudinally extending slots 122 which are in communication with the channel 116 in the lower blocks 110 and 112 and which extend at an acute angle with respect to the plane of the upper block 117. Slidably disposed within the slots 122 are elongated longitudinally extending guide members 123 and 124 which are biased downwardly toward each other and into engagement with the rounded corners of the upper side edges 20 and 22 of the film surrounding the metal conductor 12. The guide members 123 and 124 can be biased downwardly by any suitable means, such as by tension springs 130 having one end connected to the upper end of the members 123 and 124 and the other end connected to the upper side of the block 117. The guide members 123 and 124 adjacent their lower or inner ends are shaped complementary with the rounded corner portions of the wrapped conductor 12.

It should be thus apparent that as the fully wrapped metal conductor is passed through the heating means 42, it is heated in an inert atmosphere and that the laminated film 10 is firmly held against the four sides of the metal conductor 12 as it is moved therethrough. The calrod heater means 42 heats the metal conductor and film to a temperature of from about 700° F. to about 900° F. to cause the FEP layer of the laminated insulating film to soften and flow into intimate contact with the surfaces of conductor 12. Such contact is important in forming a strong adhesive bond. The length of the heater means 42 is such so as to provide sufficient time for the FEP layer to soften and flow prior to its exiting therefrom.

Figure 6:
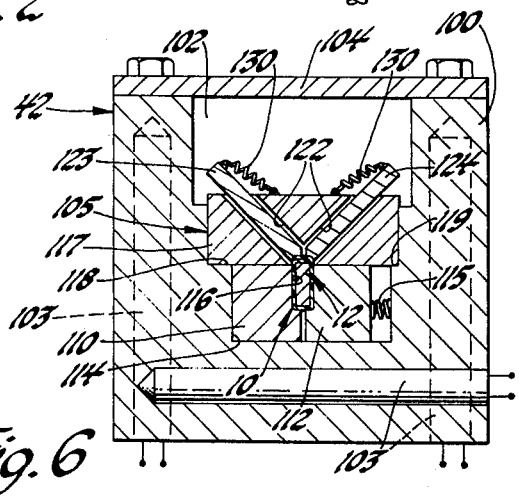
FIG. 6 is an enlarged cross sectional view of part of the apparatus shown in FIG. 2 and taken approximately along line 6—6 of FIG. 2.

After the fully wrapped metal conductor is heated and the FEP has flowed into intimate contact with the conductor 12, it is passed through a coolant means 44 in which the wrapped conductor is cooled to a temperature preferably of approximately 300° F. This cooling also takes place in an inert atmosphere. The cooling means can be of any suitable or conventional construction and is therefore not shown in detail. Suffice it to say that the cooling means would include a guide means similar to that shown in FIG. 6 and described in connection with the heater means 42 to maintain the sides of the film 10 in clamped engagement with the metal conductor 12 as it is passed through the coolant means 44. As the wrapped metal conductor passes through the coolant means 44, the FEP layer hardens and securely bonds the polyimide film portion to the metal conductor 12.

Additional cooling means can be provided after the cooled wrapped conductor passes through the cooling means 44 by passing the same through a second coolant means 46. This coolant means preferably is a water tank through which cold water is circulated. After the wrapped conductor exits from the coolant means 46, it is wrapped on a take-up reel 48.

In the practice of this invention the metal conductor is exposed to an inert gas atmosphere, preferably argon gas, from the time it enters the preheater means 36 until the time it exits from the first coolant means 44. It has been found that good bonding of the laminated insulating film to the metal conductor 12 can be achieved by heating and cooling in an inert atmosphere, since the inert atmosphere prevents any oxidation of the copper as it is being wrapped and bonded to the insulating film 10. Oxidation of the copper makes it difficult to achieve a good bond between the film coating and the copper conductor.

In its broadest form, the subject process of applying an electrically insulating laminate film to a metal conductor is suitable for applying any insulating film to a copper conductor, if the film layer, which is not adjacent to the conductor, may be laminated to a fluorinated resin layer and has the thermal stability to maintain its physical and chemical integrity at the temperatures and exposure times necessary to allow the fluorinated resin layer, which is adjacent to the conductor, to flow into intimate contact with surfaces of the conductor. One laminated film which has proved satisfactory is that marketed by DuPont under the designation Kapton F which is described as being a two layer laminate, wherein one layer is a polyimide resin and the other is a fluorinated ethylene propylene resin sold by DuPont under the tradename Teflon FEP. This particular polyimide is the condensation reaction product of pyromellitic dianhydride and a diamine and the Teflon FEP is a copolymer of tetrafluoroethylene and hexafluoropropylene. In the practice of this invention, the conductor is wrapped so that the nonadjacent layer is the polyimide resin and the adjacent layer is the fluorinated ethylene propylene resin. Other suitable resins for the nonadjacent layer would include such thermally stable materials as the polyamide resins marketed by DuPont under the trade designation Nomex.

As noted before, the advantages of the above-noted process are that a very good bond between the laminated film and the copper conductor 12 is achieved by the process and that the heating steps do not in any way affect the dielectric or insulating properties of the laminated film 10. The process also enables this type of insulating film to be bonded to a copper conductor at relatively high speeds, and the adhesive bond between the laminated film and the copper conductor substantially reduces the probability of moisture caused electrical failures when the insulated copper conductor is thereafter used as an armature coil, etc.

Although the illustrated embodiment hereof has been described in great detail, it should be apparent that certain modifications, changes, and adaptations may be made in the illustrated embodiment, and that it is intended to cover all such modifications, changes and adaptations which come within the spirit of the present invention.

What is claimed is:

1. The method of continuously applying a thermally stable laminated insulating film, wherein one layer of said laminate is a fluorinated resin which resin will soften and flow at elevated temperatures onto a metal conductor comprising the steps of:

a. simultaneously feeding the metal conductor and the laminated film longitudinally and with the fluorinated resin side of the laminate adjacent the metal conductor into a guide means;

b. wrapping the film around the metal conductor in the guide means and with the adjacent side ends of the film being in an overlapping relationship to define a longitudinally extending seam;

c. heating the wrapped metal conductor in an inert atmosphere to a temperature of from about 700° to about 900° F. to cause the layer, adjacent the conductor, to soften and to flow into intimate contact with the surfaces of the conductor while maintaining the wrapped film in clamped engagement with the metal conductor;

d. and thereafter cooling the wrapped conductor in an inert atmosphere to allow the layer adjacent the conductor to harden and bond the film to the metal conductor.

2. The method of continuously applying a thermally stable laminated insulating film wherein one layer of said laminate is a fluorinated ethylene propylene resin, onto a metal conductor comprising the steps of:

a. simultaneously feeding the metal conductor and the laminated film lengthwise and with the fluorinated resin side of the laminate adjacent the metal conductor into a guide means;

b. wrapping the film around the metal conductor in the guide means and with the adjacent side ends of the film being in an overlapping relationship to define a longitudinally extending seam;

c. heating the wrapped metal conductor in an inert atmosphere to a temperature of from about 700° F. to about 900° F. to cause the layer adjacent the conductor to soften and to flow into intimate contact with the surfaces of the metal conductor while maintaining the wrapped film in clamped engagement with the metal conductor;

d. and thereafter cooling the wrapped conductor in an inert atmosphere to allow the layer adjacent the conductor to harden and bond the film to the metal conductor.

3. The method of continuously applying a fluorinated ethylene-propylene resin-polyimide laminated electrically insulating film onto a rectangularly shaped copper conductor having opposed sides comprising the steps of:

a. simultaneously longitudinally feeding the metal conductor and the laminated film with the fluorinated ethylene propylene resin side adjacent the copper conductor into a guide means;

b. wrapping the laminated film around the copper conductor by sequentially folding the laminated film around three sides of the conductor and then in an inert atmosphere folding the adjacent ends across the fourth side in an overlapping relationship to define a longitudinally extending seam;

c. heating the wrapped conductor in an inert atmosphere to a temperature to from about 700° F. to about 900° F. to soften the fluorinated ethylene propylene resin layer and allow it to flow into intimate contact with the conductor while maintaining the wrapped film in clamped engagement with the sides of the conductor;

d. and cooling the wrapped conductor in an inert atmosphere to cause the coating to harden and bond the laminated film to the copper conductor.

4. The method of continuously applying a fluorinated ethylene-propylene resin-polyimide laminated electrically insulating film onto a rectangularly shaped copper conductor having opposed sides and ends comprising the steps of:

a. simultaneously longitudinally feeding the metal conductor and the laminated film with the fluorinated ethylene propylene resin side adjacent the copper conductor into a guide means;

b. partially wrapping the laminated film around one end and two sides of the copper conductor in the guide means and so that the film has free side portions which extend beyond and transversely of the plane of the other end of the conductor;

c. passing the partially wrapped conductor and film through an induction heating coil in an inert atmosphere to preheat the copper conductor;

d. wrapping the film in an inert atmosphere by sequentially folding the free side portions of the film over the other end of the conductor in an overlapping relationship to define a longitudinally extending seam;

e. heating the fully wrapped conductor in an inert atmosphere to a temperature of from about 700° F. to about 900° F. temperature of the polyimide, to cause the former to soften and to flow into intimate contact with the surfaces of the conductor while maintaining the wrapped film in clamped engagement with the sides of the conductor; and f. cooling the wrapped conductor in an inert atmosphere while maintaining the sides of the film in clamped engagement with the sides of the conductor, to a temperature of about 300° F. and then cooling the wrapped conductor to ambient temperature.

* * * * *